US006863742B2

(12) United States Patent
Ohashi

(10) Patent No.: US 6,863,742 B2
(45) Date of Patent: Mar. 8, 2005

(54) BULK ANISOTROPIC RARE EARTH PERMANENT MAGNET AND PREPARATION METHOD

(75) Inventor: Ken Ohashi, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/096,851

(22) Filed: Mar. 14, 2002

(65) Prior Publication Data

US 2002/0129872 A1 Sep. 19, 2002

(30) Foreign Application Priority Data

Mar. 14, 2001 (JP) ..... 2001-071890

(51) Int. Cl.[7] ..... H01F 1/059
(52) U.S. Cl. ..... 148/103; 419/13
(58) Field of Search ..... 148/301, 103; 419/13; 75/244

(56) References Cited

U.S. PATENT DOCUMENTS 5,137,587 A * 8/1992 Schultz et al. ..... 148/103
5,137,588 A * 8/1992 Wecker et al. ..... 148/103
5,769,969 A * 6/1998 Ishikawa et al. ..... 148/301

FOREIGN PATENT DOCUMENTS

EP 0369097 A1 5/1990
EP 599647 A2 6/1994
JP 2-57663 A 2/1990
JP 6-120060 4/1994
JP 6-224017 8/1994
JP 2000-294415 10/2000

OTHER PUBLICATIONS

English language translation of Japanese document No. 06–120060.*
English language translation of Japanese document No. 2000–294415 Oct. 20, 2000.*
English language translation of Japanese document No. 6–224017, Aug. 12, 1994.*
English language translation of Japanese document No. 06–20060, Oct. 1, 1992.*
Coey, J.M.D. et al., Journal of Magnetism and Magnetic Materials, 87(1990), L251–L254.
Shen, et al., *Journal of Magnetism and Magnetic Materials*, vol. 162, 1996, pp. 265–270.

* cited by examiner

*Primary Examiner*—John P. Sheehan
(74) *Attorney, Agent, or Firm*—Birch, Stewart, Kolasch & Birch, LLP

(57) ABSTRACT

A bulk anisotropic rare earth permanent magnet consists essentially of R, Fe or Fe and Co, and N, wherein R is selected from rare earth elements inclusive of Y and contains Sm as a main component, and has a primary phase of $Th_2Zn_{17}$ type rhombohedral crystal structure, a density of at least 90% of the true density, and unidirectionally oriented C-axis. By electric conduction hot pressing of SmFeN base powder under rapid heating and rapid cooling conditions, the powder can be worked into the anisotropic bulk magnet without decomposing the 2–17 phase.

3 Claims, 2 Drawing Sheets

BULK ANISOTROPIC RARE EARTH PERMANENT MAGNET AND PREPARATION METHOD

This invention relates to bulk anisotropic rare earth permanent magnets suitable for use in electronic equipment, especially head driving actuators of hard disk drives and a method for preparing the same.

BACKGROUND OF THE INVENTION $R_2Fe_{17}$ compounds wherein R is selected from rare earth elements inclusive of yttrium are intermetallic compounds having either a $Th_2Zn_{17}$ type rhombohedral crystal structure or a $Th_2Ni_{17}$ type hexagonal crystal structure. While permanent magnet materials must meet the three major requirements: (a) high saturation magnetization, (b) a high Curie temperature, and (c) a high crystal magnetic anisotropy constant, these compounds, which satisfy only requirement (a), have not been considered as a candidate for permanent magnets. However, around 1990, Coey et al. and Iriyama et al. discovered that interstitial incorporation of nitrogen (N) into $R_2Fe_{17}$ compounds drastically alters their magnetic properties. See J. M. D. Coey and H. Sun, Journal of Magnetism and Magnetic Materials, 87 (1990), L 251; H. Imai and T. Iriyama, Japanese Application No. 228547/88, 1988; T. Irlyama, K. Kobayashi and H. Imai EP 0369097 A1, 1989. It is possible to incorporate at most three N atoms per compositional formula: $R_2Fe_{17}N_x$ and at sites surrounding R atoms. As a result of N atoms incorporated, the lattice constant is elongated in both a and c axes, leading to a lattice expansion of at least several percents by volume. For all compounds having N incorporated therein, substantial increases of Curie temperature (Tc) are found. Crystal magnetic anisotropy changes from a negative value prior to nitriding to a large positive value of the order of $10^7$ erg/cm$^3$ in the case of $Sm_2Fe_{17}N_3$. In the cases of Nd and Pr systems, their crystal magnetic anisotropy remains negative because the orbit of 4f electrons in rare earth atom responsible for magnetism is flattened (as opposed to the cigar shape of the Sm system). The $Sm_2Fe_{17}N_3$ compound has a saturation magnetization of 15.6 kG which is comparable to that (16 kG) of NdFeB compounds. Therefore, among $R_2Fe_{17}N_3$ compounds, only $Sm_2Fe_{17}N_3$ satisfies the three major requirements of permanent magnets and has a potential to become an excellent permanent magnet.

Nitriding of $R_2Fe_{17}$ is generally carried out by heating magnetic powder to a temperature below the decomposition temperature and placing the powder in a $N_2$ gas atmosphere at the temperature. To this end, not only the $N_2$ gas, but also a gas mixture of $N_2$+$H_2$ or a gas mixture of $NH_3$+$H_2$ may be used. These gas mixtures are advantageous in that magnetic particles are fully nitrided because $H_2$ gas is occluded by the compound to bring about interstitial expansion whereby microcracks are induced in magnetic particles to accelerate diffusion of $N_2$ or $NH_3$ gas into magnetic particle surfaces. Sometimes $N_2$ gas under high pressure is used.

$R_2Fe_{17}N_3$ suffers from the problem that the nitride decomposes at about 600° C. or higher into $RN_x$ and Fe as shown by the following scheme.

$$R_2Fe_{17}N_3 \xrightarrow[\text{above } \sim 600^\circ \text{ C.}]{} 2RN_x + 17Fe$$

FIG. 1 is a diagram showing differential thermal analysis (DTA) curves of $Sm_2Fe_{17}N_3$ magnetic powder when heated at different temperatures in an Ar gas atmosphere. It is seen that decomposition starts little by little from a temperature of 500° C. or above. Attempts were made to add an additive to the alloy to elevate the decomposition temperature, and marked a mere elevation within 100° C. at maximum. Since the sintering temperature used in the sintering of rare earth-transition metal compounds by powder metallurgy is usually at or above 1,100° C., it is difficult to work the nitride powder into a bulk magnet by powder metallurgy. It may be devised to subject the sintered body to nitriding, although it is difficult to effect nitriding throughout the body in the bulk compound state because nitriding takes place through surface diffusion. Therefore, no reports showing a success in producing $Sm_2Fe_{17}N_3$ magnet in bulk form have been found in the art except for the pulse ultrahigh pressure process using a gas gun. The pulse ultrahigh pressure process involves charging the target of the gas gun with a magnetic powder and striking the target against a barrier to apply instantaneous pulse impact pressures and is utterly unacceptable in the industry.

For the above reason, the $R_2Fe_{17}N_3$ magnetic powder composed mainly of $Sm_2Fe_{17}N_3$ is used to produce bonded magnets because the powder can be processed as such. Since $Sm_2Fe_{17}N_3$ has a significant anisotropic magnetic field, a practically satisfactory coercivity is obtained in fine particle form. By placing the fine particles in a magnetic field for orientation, an anisotropic bonded magnet can be produced. (BH)max values of approximately 20 MGOe (160 kJ/m$^3$) have been reported, though on the laboratory level.

Although the $R_2Fe_{17}N_3$ magnet composed mainly of $Sm_2Fe_{17}N_3$ exhibits more or less satisfactory characteristics in anisotropic bonded magnet form, its application is limited because it cannot be converted into a bulk body by a practically acceptable method.

SUMMARY OF THE INVENTION

An object of the invention is to provide a bulk anisotropic rare earth permanent magnet having a primary $Sm_2Fe_{17}N_3$ phase and a method for preparing the same.

In a first aspect, the invention provides a bulk anisotropic rare earth permanent magnet consisting essentially of R, Fe or Fe and Co, and N, wherein R is selected from rare earth elements inclusive of Y and contains Sm as a main component, and having a primary phase of $Th_2Zn_{17}$ type rhombohedral crystal structure, a density of at least 90% of the true density, and unidirectionally oriented C-axis.

In a preferred embodiment, the permanent magnet consists essentially of R', Fe and N wherein R' is Sm or a combination of Sm with at least one of Ce, Pr and Nd, is represented by the compositional formula: $R'Fe_zN_x$ wherein z is a number from 8 to 9 and x is a number from 2 to 3.5, and has unidirectionally oriented C-axis.

In another preferred embodiment, the permanent magnet consists essentially of R', Fe, Co and N wherein R' is Sm or a combination of Sm with at least one of Ce, Pr and Nd, is represented by the compositional formula: $R'(Fe_{1-y}Co_y)_zN_x$ wherein z is a number from 8 to 9, x is a number from 2 to 3.5, and y is a number from more than 0 to 0.3, and has unidirectionally oriented C-axis.

At least one element selected from among Ti, Mo, V, Ta, Zr, Hf, W, Al and Si may substitute for up to 5 atom % of Fe and Co combined.

In a second aspect, the invention provides a method for preparing a bulk anisotropic rare earth permanent magnet, comprising the steps of placing in a magnetic field a rare earth magnet powder consisting essentially of R, Fe or Fe and Co, and N, wherein R is as defined above, and having a primary phase of $Th_2Zn_{17}$ type rhombohedral crystal structure, so that C-axis is oriented in the magnetic field direction; and monoaxial hot pressing the powder into a bulk body. Preferably, the orienting magnetic field is at least 800 kA/m, and the monoaxial hot pressing step includes heating to the highest temperature within a time of 2 seconds to 5 minutes, and cooling therefrom to below 300° C. within a time of 5 seconds to 10 minutes.

DESCRIPTION OF THE PREFERRED EMBODIMENTS

Figures 1A, 1B, 1C, 1D, 1E:
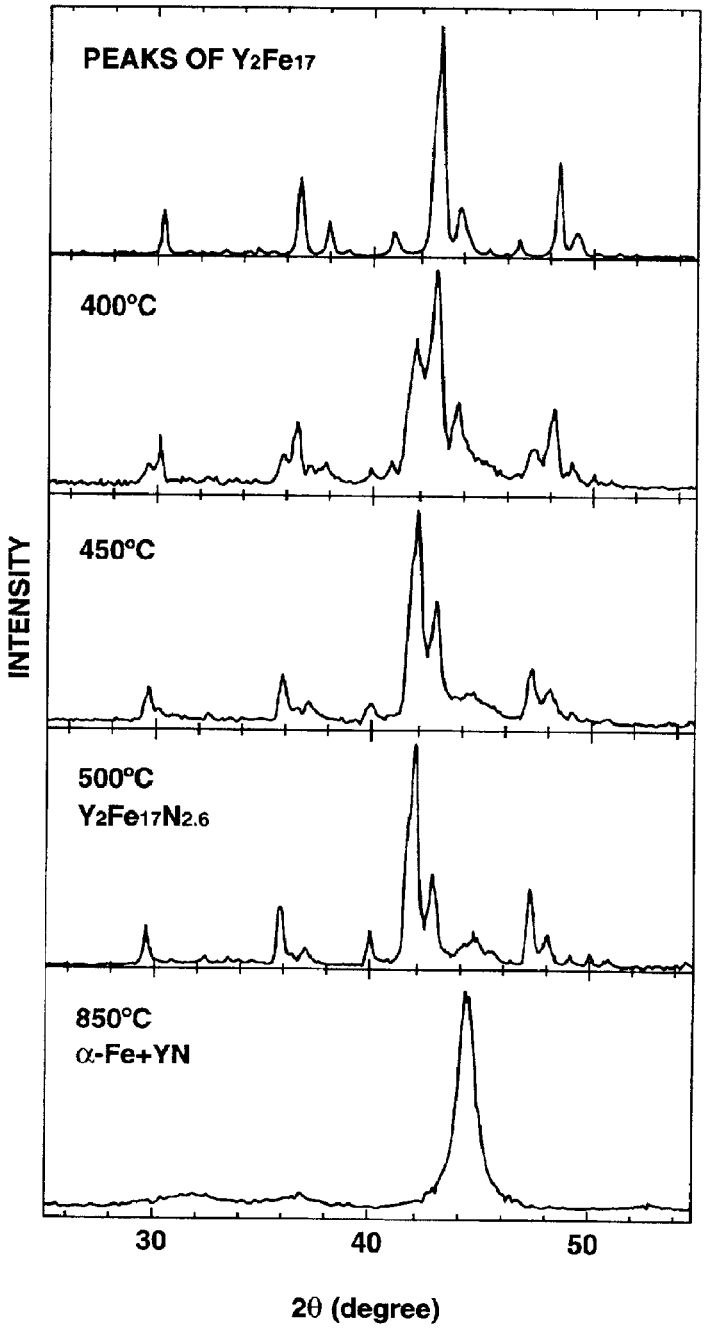
FIG. 1 is a diagram showing DTA curves of $Sm_2Fe_{17}N_3$ powder when decomposed at elevated temperatures.

In order to manufacture a $R_2Fe_{17}N_3$ bulk magnet composed mainly of $Sm_2Fe_{17}N_3$, there are contemplated three routes including (1) increasing the decomposition temperature of $R_2Fe_{17}N_3$ material to above the sintering temperature, (2) processing $R_2Fe_{17}N_3$ material into a bulk body at a temperature below its decomposition temperature, and (3) processing $R_2Fe_{17}N_3$ material above the decomposition temperature, but by rapid heating and cooling so that bulk formation is completed within a brief time.

However, because the difference between the decomposition temperature and the sintering temperature is more than 500° C. as mentioned previously, it is almost impossible for route (1) to increase the decomposition temperature by several hundred degrees of centigrade. Route (2) has not been reported to date, though might be possible, because for example, $Sm_2Fe_{17}N_3$ material must be converted into a bulk body at 600° C. or below. One example of route (3) is bulk formation by pulse impact pressures, which is almost impractical as previously mentioned.

Through extensive investigations, the inventor has found that a $R_2Fe_{17}N_3$ bulk magnet composed mainly of $Sm_2Fe_{17}N_3$ is obtainable through route (3). However, a precise study on the inventive procedure reveals that the state of route (3) occurs only in proximity to grain boundaries, and the temperature in the grain interior does not rise above the decomposition temperature. Therefore, the inventive procedure is a combination of routes (3) and (2), which will be later described at large.

The permanent magnet of the invention consists essentially of R, iron or a mixture of iron and cobalt, and nitrogen, wherein R is selected from rare earth elements inclusive of yttrium and contains samarium as a main component. It has a primary phase of the $Th_2Zn_{17}$ type with a rhombohedral crystal structure. The term "consisting essentially of" is used in a sense that the presence of impurities formed by oxidation or carbonization during pulverization and heat treatment steps and incidental impurities entrained from raw materials is allowable, and encompasses the materials in which up to 5 atom % of Fe and Co combined is substituted with at least one element selected from the group consisting of Ti, Mo, V, Ta, Zr, Hf, W, Al and Si.

As used herein, the term "containing samarium as a main component" means that samarium accounts for at least 50 atom %, especially at least 80 atom % of the entire R. R is Sm in the most preferred embodiment although R may be a mixture of Sm with at least one element of Ce, Pr, Nd, etc. Pr and Nd are effective for increasing saturation magnetization, however, it is desirable to limit the amount of Pr and Nd to 30 atom % or less of the entire rare earth elements because more substitution of Pr or Nd for Sm can lead to a coercivity decline. Ce is more rich in resource and inexpensive than Sm, however, it is desirable to limit the amount of Ce to 30 atom % or less of the entire rare earth elements because it causes saturation magnetization and coercivity to decrease in substantial proportion to the substitution amount.

The permanent magnet of the invention is preferably represented by the compositional formula:

$$RFe_zN_x \text{ or } R(Fe_{1-y}Co_y)_zN_x,$$

and more preferably $$R'Fe_zN_x \text{ or } R'(Fe_{1-y}Co_y)_zN_x$$

wherein R is as defined above, R' is Sm or a mixture of Sm with at least one element of Ce, Pr and Nd, z, x and y are numbers satisfying the range: $8 \leqq z \leqq 9$, $2 \leqq x \leqq 3.5$, and $0 < y \leqq 0.3$.

Substitution of Co for Fe as indicated in the above formula provides a rise of Curie temperature and a little increase of saturation magnetization, however, it is desirable to limit the amount of Co (represented by y) to 30 atom % or less of the entire transition metals because much substitution leads to a coercivity decline. The ratio of transition metal to rare earth (represented by z) need not necessarily be the stoichiometric ratio of 8.5. However, the regions of $z<8$ and $9<z$ are undesirable because the 2–17 compound is not stabilized. With respect to the amount of N incorporated, incorporation of three atoms per compositional formula is crystallographically maximum and offers best magnetic properties although incorporation of nitrogen atoms in short or in excess at sites other than the normal interstitial sites does not substantially degrade magnetic properties if $2 \leqq x \leqq 3.5$. While the magnet is basically represented by the compositional formula: $RFe_zN_x$ or $R(Fe_{1-y}Co_y)_zN_x$, an additive element may be contained for coercivity improvement purposes. Useful additive elements include transition metals such as Ti, Mo, V, Ta, Zr, Hf and W and Al, Si, etc. and they substitute for Fe and Co. Since an excessive amount of such additive element(s) may rather invite a sharp drop of saturation magnetization and a coercivity decline, it is desirable that the content of additive element(s) be up to 5 atom %, especially up to 3 atom % of the transition metals.

The permanent magnet of the invention is an anisotropic bulk body having a density of at least 90%, preferably at least 93% of the true density and unidirectionally oriented C-axis.

According to the invention, the bulk anisotropic rare earth permanent magnet defined above is prepared by placing a rare earth magnet powder in a magnetic field so that C-axis is oriented in the magnetic field direction, and monoaxial hot pressing the powder into a bulk body.

More specifically, the inventive method involves a $R_2Fe_{17}N_3$ system composed mainly of $Sm_2Fe_{17}N_3$. The inventor studied the decomposition process thereof at elevated temperatures. It has been found that decomposition of $R_2Fe_{17}N_3$ does not occur instantaneously, but requires a time of the order of 1 to 10 minutes or more even at a temperature of 600° C. or higher, though the time varies at different temperatures (that is, the higher the temperature, the shorter becomes the decomposition time). Accordingly, if heating and cooling are possible, even above the decomposition temperature, within a brief time, there is a possibility that the $R_2Fe_{17}N_3$ system composed mainly of $Sm_2Fe_{17}N_3$ be converted into a bulk body prior to decomposition. However, since the consolidation process due to sintering is not instantaneously completed, it is not sufficient to merely subject a shaped compact to rapid heating and cooling.

Figure 2:
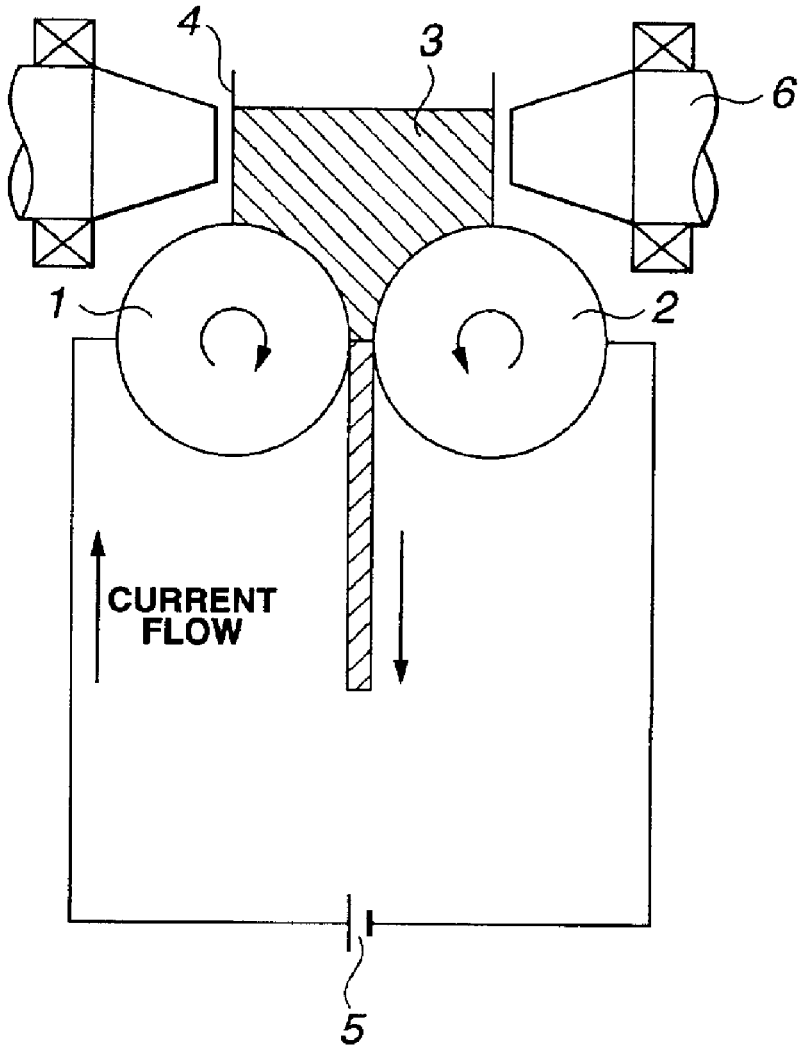
FIG. 2 is a schematic view of a powder rolling/electric sintering apparatus used in the invention.

It has been found that the $R_2Fe_{17}N_3$ system composed mainly of $Sm_2Fe_{17}N_3$ can be converted into a bulk body by heating only a compressed portion of magnetic powder and simultaneously carrying out pressurizing, shaping and heating. The application of pressure during heating promotes atomic migration among powder particles for converting the powder into a bulk body. The means used to this end may be a conventional hot press or analogous equipment capable of heating and cooling at a high rate although an apparatus as shown in FIG. 2 is advantageous. In the apparatus of FIG. 2, powder is admitted from a hopper to between rolls where rolling and electricity conduction are simultaneously effected on the powder. A high current flow is conducted through the powder pressed (or rolled) between the rolls.

It is preferred that the magnetic particles used herein have an average particle diameter of 2 to 10 $\mu$m, especially 3 to 6 $\mu$m.

More specifically, the apparatus of FIG. 2 includes a pair of rolls 1 and 2, a hopper 4 disposed above the rolls for containing a magnetic powder 3, and a dc power supply 5 connected to the rolls 1 and 2. The hopper 4 feeds the magnetic powder 3 to between the rolls 1 and 2 where the powder is pressurized while current flow is conducted from the power supply 5 to the magnetic powder through the rolls 1 and 2 to thereby heat the magnetic powder. The magnetic powder which is pressurized and heated in this way is delivered out of the rolls in a sheet or strip form.

As also shown in FIG. 2, electromagnets 6 are disposed to face the magnetic powder in the hopper 4 for applying a magnetic field to the magnetic powder for orientation of magnetic particles in the magnetic field direction. The inventor previously proposed in Japanese Patent Application No. 11-97355 to convert a SmFeN system into a bulk body without resorting to a magnetic field orientation unit. According to the present invention, particle orienting electromagnets are arranged in a front stage of the electric conduction powder rolling apparatus for orienting fine particles in the magnetic field direction so that the oriented fine particles are rolled by the apparatus into a bulk body. There is obtained a bulk body with anisotropy. The direction in which the magnetic field is applied to the powder may be either of two directions, a vertical (or thickness) direction and a transverse (or width) direction with respect to a rolled strip. Application of the magnetic field in the transverse direction is desirable from the magnetic property standpoint whereas the vertical direction is preferred from the standpoint of apparatus compactness. Either one of the directions is chosen depending on which standpoint is of importance.

In the present process, since the powder state is maintained until the powder compression by rolls proceeds to a certain extent, power supply does not cause electric current to flow through the powder region, which is little heated. When the powder is sufficiently compressed near the rolls, electric current starts to flow. The electric current flow becomes maximum at the minimum gap between rolls. As moving apart from the rolls, the quantity of electricity conducted rapidly decreases. Therefore, electric conduction through the powder or bulk body occurs only immediately before and after the minimum roll gap and for a very short time. Immediately after the rolled strip leaves the rolls, a cooling phase starts. Therefore, the duration for which the rolled $R_2Fe_{17}N_3$ material composed mainly of $Sm_2Fe_{17}N_3$ is being heated at or above its decomposition temperature is very short. In the preferred monoaxial hot pressing process, the heating step to the highest temperature is effected within a time of 2 seconds to 5 minutes, and the cooling step from the holding temperature to below 300° C. is effected within a time of 5 seconds to 10 minutes. A time duration of heating in this range causes little decomposition, ensuring that a $R_2Fe_{17}N_3$ bulk magnet composed mainly of $Sm_2Fe_{17}N_3$ is obtained. It is understood that the highest temperature is reached at a position immediately downstream of the minimum gap between rolls, but the highest temperature is not measurable because that position is not visually observable or directly accessible and electric current is flowing at that position. Once the rolled strip moves to a visually observable position, the temperature is measurable using an optical pyrometer, for example. However, this temperature is not the highest temperature. There is no means of determining the highest temperature, except for presumption. Nevertheless, the highest temperature and the heating and cooling rates can be optimized by adjusting the current flow conducted between rolls and the number of roll revolutions, and the degree of compression be optimized by adjusting the pressure and the gap between rolls. The current conducting, pressure rolling zone is preferably held in an inert gas atmosphere or vacuum atmosphere for preventing the rolled strip from oxidative degradation. The rolls may be used in one stage or in multiple stages. In this way, the bulk strip is obtained by hot monoaxial pressing while the roll peripheral speed is set at 0.1 to 50 mm/sec, though not limited thereto.

A precise study on the densification process has revealed that electric current flows via contacts between crystal grains. Grain surfaces are preferentially heated while the interiors are not heated above the decomposition temperature. This results an ideal densification process that heated sub-surface regions of adjacent grains fuse together to contribute to densification while the interiors are not decomposed, i.e., are kept intact. This is first established by a new process of electric sintering combined with rolling.

The densification or consolidation of the material according to the invention is possible with a pressing/electric sintering process (e.g., spark plasma sintering, SPS) analogous to the rolling/electric sintering process. However, the pressing/electric sintering process has a likelihood that the phase be partially decomposed because the cooling time may exceed 10 minutes depending on the heat mass around the press mold.

The composition and method of the invention enables to produce a $R_2Fe_{17}N_3$ bulk magnet composed mainly of $Sm_2Fe_{17}N_3$ which has never been obtained in bulk form in the prior art.

EXAMPLE

Examples of the invention are given below by way of illustration and not by way of limitation.

Example 1

Sm of 99% purity and Fe of 99% purity were weighed and melted in an RF melting furnace in an inert gas atmosphere SO as to give the compositional formula: $Sm_2Fe_{17}$. The furnace was tilted to pour the melt onto a rotating chill roll for cooling, obtaining thin flakes. On powder x-ray diffraction analysis, these flakes were found to be $Sm_2Fe_{17}$ of the $Th_2Zn_{17}$ type although they contained trace amounts of incidental impurities (oxygen, carbon, etc.) entrained from the raw materials and melting process. Using a Brown mill, the flakes were ground to 50 mesh under. For nitrogen exposure, the resulting coarse particles were held at 450° C.

in $N_2$ gas under 2 atm. for 24 hours. By injecting jet streams of $N_2$ gas, the nitrided coarse particles were atomized into fine particles having an average diameter of 3 $\mu$m. The fine nitride powder was admitted into the apparatus shown in FIG. 2 as having a current conducting powder rolling mill combined with electromagnets. A magnetic field of 955 kA/m was applied in the thickness direction of a rolled strip to exit therefrom for orienting the fine particles in that direction. The oriented particles were rolled into a bulk strip by the rolling/electric sintering process in an Ar gas atmosphere. The monoaxial applied pressure was 500 kg/cm$^2$ on the average, and the electric current was 10 kA. The roll peripheral speed was 1 mm/sec, which indicated that heating from the decomposition temperature of 650° C. to the highest temperature region took about 30 seconds and cooling from the highest temperature to below 300° C. took about 50 seconds.

There was produced a strip of 20 mm wide and 1 mm thick, from which opposite transverse ends of 2.5 mm were cut off. The strip specimen of 15 mm wide was examined, finding anisotropic magnetic properties including a remanence Br=1.40 T and a coercive force iHc=750 kA/m. The composition of the strip specimen was analyzed to find a nearly stoichiometric composition of $SmFe_{8.6}N_{2.85}$. X-ray diffraction showed that C-axis was oriented in the thickness direction and the 2–17 structure was not disrupted. The density was 8.25 g/cm$^3$ which was 96% of the true density.

Example 2

The procedure of Example 1 was followed except that formulation was adjusted so as to give the composition: $R(Fe_{0.8}Co_{0.2})_{8.7}N_{3.3}$. The roll pressure of the rolling/electric sintering apparatus was changed to 1 ton/cm$^2$ on the average. The strip thus obtained exhibited magnetic properties including a remanence Br=1.50 T and a coercive force iHc=640 kA/m, that is, an increase of remanence and a little decrease of coercive force as compared with Example 1. The density was 8.30 g/cm$^3$ which was 97% of the true density.

According to the invention, by electric conduction hot pressing of SmFeN base powder under rapid heating and rapid cooling conditions, the powder can be worked into an anisotropic bulk magnet without decomposing the 2–17 phase.

Japanese Patent Application No. 2001-071890 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for preparing a bulk anisotropic rare earth permanent magnet, comprising the steps of:

placing in a magnetic field of at least 800 kA/m a rare earth magnet powder consisting essentially of R, Fe or Fe and Co, and N, wherein R is selected from rare earth elements inclusive of Y and contains Sm as a main component, and having a primary phase of $Th_2Zn_{17}$ crystal structure, so that C-axis is oriented in the magnetic field direction, and monoaxially hot pressing the powder into a bulk body while heating the powder to the highest temperature within a time of 2 seconds to 5 minutes to provide a heated bulk body; and cooling the heated bulk body to below 300° C. within a time of 5 seconds to 10 minutes, thereby obtaining a bulk anisotropic rare earth permanent magnet consisting essentially of R, Fe or Fe and Co, and N, wherein R is selected from the rare earth elements inclusive of Y and contains Sm as a main component and having a primary phase of $Th_2Zn_{17}$ crystal structure, a density of at least 90% of the true density and unidirectionally oriented C-axis.

2. The method of claim 1 wherein the hot pressing is conducted by using an apparatus comprising a pair of rolls, a hopper disposed above the rolls for containing the magnetic powder and a dc power supply connected to the rolls so that the hopper feeds the magnetic powder to between the rolls where the powder is pressurized while current flow is conducted from the power supply to the magnetic powder through the rolls to thereby heat the magnetic powder.

3. A method for preparing a bulk anisotropic rare earth permanent magnet, comprising the steps of:

(I) providing a rare earth magnet powder consisting essentially of R, Fe or Fe and Co, and N, wherein R is selected from rare earth elements inclusive of Y and contains Sm as a main component, and having a primary phase of $Th_2Zn_{17}$ crystal structure (II) subjecting the powder to a magnetic field of at least 800 kA/m, thereby orienting the C-axis in the direction of the magnetic field thereby producing an oriented powder, and (III) passing the oriented powder through the nip between two rotating rolls maintained at a different voltage thereby simultaneously monoaxially pressing and heating the oriented powder to a temperature, the highest value of which, is reached within a time of 2 seconds to 5 minutes thereby providing a heated bulk body; and (IV) cooling the heated bulk body to below 300° C. within a time of 5 seconds to 10 minutes, thereby obtaining a bulk anisotropic rare earth permanent magnet consisting essentially of R, Fe or Fe and Co, and N, wherein R is selected from the rare earth elements inclusive of Y and contains Sm as a main component and having a primary phase of $Th_2Zn_{17}$ crystal structure, a density of at least 90% of the true density and unidirectionally oriented C-axis.

* * * * *